US008328952B2

(12) United States Patent
Jukes et al.

(10) Patent No.: US 8,328,952 B2
(45) Date of Patent: Dec. 11, 2012

(54) METHOD OF PERFUMING

(75) Inventors: Amanda Kiser Jukes, Tyne & Wear (GB); Natasha Eve Ferguson, Tyne & Wear (GB); Nicola Jane Binney, Newcastle upon Tyne (GB); Anju Deepali Massey Brooker, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/088,441

(22) Filed: Apr. 18, 2011

(65) Prior Publication Data

US 2012/0103369 A1 May 3, 2012

(30) Foreign Application Priority Data

Apr. 23, 2010 (EP) ..... 10160965

(51) Int. Cl.
*B08B 3/04* (2006.01)

(52) U.S. Cl. ..... 134/25.5; 134/6; 134/18; 134/25.1; 134/25.2; 134/25.4; 134/42; 510/101; 510/107

(58) Field of Classification Search ..... 510/101, 510/107; 134/6, 18, 25.1, 25.2, 25.4, 42
See application file for complete search history.

(56) References Cited

U.S. PATENT DOCUMENTS

| | | | | |
|---|---|---|---|---|
| 3,880,765 | A | 4/1975 | Watson | |
| 4,000,093 | A | 12/1976 | Nicol et al. | |
| 4,246,612 | A | 1/1981 | Berry et al. | |
| 4,340,766 | A | 7/1982 | Klahr et al. | |
| 4,760,025 | A | 7/1988 | Estell et al. | |
| 4,810,410 | A | 3/1989 | Diakun et al. | |
| 5,114,611 | A | 5/1992 | Van Kralingen et al. | |
| 5,227,084 | A | 7/1993 | Martens et al. | |
| 5,244,594 | A | 9/1993 | Favre et al. | |
| 5,528,867 | A | 6/1996 | Thompson | |
| 5,576,281 | A | 11/1996 | Bunch et al. | |
| 5,679,630 | A | 10/1997 | Baeck et al. | |
| 5,695,679 | A | 12/1997 | Christie | |
| 5,763,385 | A | 6/1998 | Bott et al. | |
| 5,824,532 | A | 10/1998 | Barnett et al. | |
| 5,856,164 | A | 1/1999 | Outtrup et al. | |
| 5,989,169 | A | 11/1999 | Svendsen et al. | |
| 6,093,562 | A | 7/2000 | Bisgard-Frantzen et al. | |
| 6,143,707 | A * | 11/2000 | Trinh et al. | 510/220 |
| 6,187,576 | B1 | 2/2001 | Svendsen et al. | |
| 6,204,232 | B1 | 3/2001 | Borchert et al. | |
| 6,312,936 | B1 | 11/2001 | Poulose et al. | |
| 6,403,355 | B1 | 6/2002 | Hagihara et al. | |
| 6,599,871 | B2 | 7/2003 | Smith | |
| 6,605,458 | B1 | 8/2003 | Hansen et al. | |
| 6,638,748 | B2 | 10/2003 | Hatada et al. | |
| 7,141,403 | B2 | 11/2006 | Outtrup et al. | |
| 7,262,042 | B2 | 8/2007 | Weber et al. | |
| 7,985,569 | B2 | 7/2011 | Aehle et al. | |
| 2006/0223734 | A1 * | 10/2006 | Bayersdoerfer et al. | 510/222 |
| 2008/0132625 | A1 | 6/2008 | Niehaus et al. | |
| 2008/0176781 | A1 * | 7/2008 | Fadel et al. | 510/106 |
| 2008/0293604 | A1 | 11/2008 | Gibis et al. | |
| 2008/0293610 | A1 | 11/2008 | Shaw et al. | |
| 2008/0305977 | A1 * | 12/2008 | Smets et al. | 510/103 |
| 2009/0075855 | A1 | 3/2009 | Gibis et al. | |
| 2009/0238787 | A1 * | 9/2009 | Finke et al. | 424/65 |
| 2010/0016203 | A1 | 1/2010 | Warkotsch et al. | |
| 2010/0031978 | A1 | 2/2010 | Housmekerides et al. | |
| 2010/0104488 | A1 | 4/2010 | Housmekerides et al. | |
| 2010/0154832 | A1 | 6/2010 | Zipfel et al. | |
| 2010/0160204 | A1 | 6/2010 | Zipfel et al. | |
| 2011/0053819 | A1 | 3/2011 | Preuschen et al. | |
| 2011/0059517 | A1 | 3/2011 | Augustinus et al. | |
| 2011/0130320 | A1 * | 6/2011 | Wiedemann et al. | 510/513 |
| 2011/0152157 | A1 * | 6/2011 | Woo et al. | 510/236 |

FOREIGN PATENT DOCUMENTS

| | | | |
|---|---|---|---|
| WO | WO 94/02597 | A1 | 2/1994 |
| WO | WO 00/60060 | A2 | 10/2000 |
| WO | WO 2006/002643 | A2 | 1/2006 |
| WO | WO 2009/021867 | A2 | 2/2009 |

* cited by examiner

*Primary Examiner* — Bibi Carrillo
(74) *Attorney, Agent, or Firm* — Tiffany M. Zerby; Leonard W. Lewis

(57) ABSTRACT

A method of perfuming in automatic dishwashing comprising the step of providing a first perfume into an automatic dishwashing machine wherein the first perfume is capable of generating a second perfume comprising from about 0.001% to about 10% by weight thereof of a sulphurous compound.

11 Claims, No Drawings

METHOD OF PERFUMING

TECHNICAL FIELD

The present invention is in the field of perfuming, especially it relates to a method of perfuming in automatic dishwashing and to an automatic dishwashing composition capable of providing perfuming.

BACKGROUND OF THE INVENTION

Traditionally automatic dishwashing products comprise a perfume. The perfume usually provides good smell to the product per se.

Items to be cleaned in an automatic dishwashing machine are soiled with food residues. The nature of the residues is quite diverse depending on the food that has been deposited on or cooked in the dishware/tableware. Usually the food residues have a plurality of malodours associated to them. Malodours can also come from food residues accumulated in dishwasher's parts such as the filter. The filter is usually a wet environment with food residues prone to bacteria degradation that usually have malodours associated to it.

The malodours can become evident during the automatic dishwashing operation either because there is superposition or combination of malodours that in terms give rise to other malodours and/or because the high temperature and humidity conditions found during an automatic dishwashing operation contributes to an easier perception of the malodours. Malodours can also be evident upon loading the dishwasher, especially if food residues degrade or rot.

Automatic dishwashing machines are usually placed in kitchens where users cook and frequently eat and they do not like to have unpleasant odours coming from the automatic dishwashing machine.

There is a need to reduce or eliminate the malodours that are generated during an automatic dishwashing process and to substitute the malodours by pleasant fragrance in the area surrounding the dishwasher during use.

SUMMARY OF THE INVENTION

According to a first aspect of the invention there is provided a method of perfuming in automatic dishwashing. Perfuming can occur during an automatic dishwashing operation and/or during the loading and unloading of the automatic dishwashing machine.

The method comprises the step of providing a first perfume into an automatic dishwashing machine (herein also referred as dishwasher). The first perfume generates a second perfume when combined with the malodour generated in automatic dishwashing. The second perfume comprises from about 0.0001% to about 10%, preferably from about 0.0002% to about 2% and especially from about 0.0005% to about 1% by weight of the second perfume of a sulphurous compound.

A perfume is not just a smell or not even a mixture of pleasantly smelling materials but a harmonious balanced blend of ingredients that are olfactively pleasant to the user. Anybody can distinguish between a perfume and an unpleasant odour.

It has now been found that a great number of malodours associated to automatic dishwashing are generated by sulphurous compounds, for example garlic, onion, meat, cabbage, etc malodours include sulphurous compounds in particular organosulphur compounds. Food degradation in certain dishwasher parts such as the filter can give rise to bacteria that can generate sulphurous compounds that further contribute to the malodour frequently found in dishwashers.

Odor perception and description are highly subjective in nature. Nevertheless, there is a generally agreed-upon odor vocabulary that is used to characterize individual ingredients and finished fragrances (see Kirk-Othmer Encyclopedia of Chemical Technology, volume 18, fourth edition, page 173). Perfumery descriptors can be classified in five groups: floral, citrus, woody, green and fruity. The perfumes of the present invention, both first and second perfumes are fruity, citrus, floral and/or green. In addition the first perfume has to be able to combine with sulphurous compounds to give a second perfume.

The method of the present invention relies on the realisation that some perfumes (first perfume, using the present terminology) can accept sulphurous compounds, in particular organosulphur compounds to give rise to other perfumes (second perfume, using the present terminology).

Some of the most common perfumes used in automatic dishwashing detergents have citrus connotations, such as for example lemony perfumes. Not all citrus perfumes give rise to an olfactory pleasant odour when exposed to moderate levels of sulphurous compounds, thus not all citrus perfumes cannot be considered as "first perfume" within the meaning of the present invention. For example, a lemony perfume would not be considered "first perfume".

In preferred embodiments the first perfume comprises low levels of a sulphurous compound. Perfumes with low levels of sulphurous compounds can readily combine with sulphurous compounds when exposed to the sulphurous malodours typically found in dishwashing to give rise to the second perfume. First perfumes comprising from about 0.00001% to about 5%, preferably from about 0.0001% to about 2% and especially from about 0.0002% to about 1% by weight of the first perfume of a sulphurous compound have been found especially suitable for the method of the invention.

By "organosulphur compound" is herein meant a compound comprising at least one carbon-sulphur bond.

In some embodiments the first perfume can be delivered during an automatic dishwashing operation. It can be delivered into any one or more of the cycles of the operation (pre-wash, main-wash and/or rinse). If delivered during the dishwashing operation it would preferably be delivered as part of the main detergent, preferably during the main-wash and/or any of the rinse cycles.

In other embodiments the first perfume can be provided by means of a dishwashing additive. Dishwashing additives include rinse aid, machine cleaner, machine freshener, drying aid, etc. A preferred method of providing the first perfume herein is by means of a machine freshener that continuously delivers the first perfume. Thus the perfuming benefit is achieved during an automatic dishwashing operation and also in between operations.

According to the second aspect of the invention there is provided an automatic dishwashing composition comprising from about 0.001% to about 5%, preferably from about 0.005% to about 1% and more preferably from about 0.01% to about 0.5% by weight of the composition of a first perfume capable to generate a second perfume, the second perfume comprising from about 0.0001% to about 10%, preferably from about 0.0002% to about 2% and especially from about 0.0005% to about 1% by weight of the second perfume of a sulphurous compound. In a preferred embodiment the automatic dishwashing composition comprises a protease. Proteases break down proteins given rise to sulphurous compounds. The method and product of the invention are capable to provide perfuming even when the automatic dishwashing detergent composition comprises a high level of proteases.

The preferred protease for use herein demonstrates at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627: 68, 87, 99, 101, 103, 104, 118, 128, 129, 130, 167, 170, 194, 205 & 222 and optionally one or more insertions in the region comprising amino acids 95-103. Preferably, the mutations are selected from one or more, preferably two or more and more preferably three or more of the following: V68A, N87S, S99D, S99SD, S99A, S101G, S103A, V104N/I, Y167A, R170S, A194P, V205I and/or M222S.

The features of the first perfume of the method of the invention apply mutatis mutandis to the first perfume of the second aspect of the invention.

DETAILED DESCRIPTION OF THE INVENTION

The present invention envisages a method of perfuming during automatic dishwashing. The method provides a first perfume that generates a second perfume when exposed to the sulphurous malodours found in automatic dishwashing. This method provides a multitude of benefits: i) the user can enjoy a first perfume while charging the dishwasher with a dishwashing product comprising the first perfume; ii) the user can enjoy the second perfume during the course of the dishwashing operation; and iii) the user can enjoy the second perfume in between dishwashing operations (i.e., loading and unloading the dishwasher).

An automatic dishwashing operation typically comprises three or more cycles: a pre-wash cycle, a main-wash cycle and one or more rinse cycles. The pre-wash is usually a cold water cycle, the main-wash is usually a hot water cycle, the water comes in cold and is heated up to about 55 or 65° C. Rinsing usually comprises two or more separate cycles following the main wash, the first being cold and, the final one starting cold with heat-up to about 65° C. or 70° C.

The first perfume can be delivered during a dishwashing operation, into any one or more of the cycles. It is preferably delivered into the main wash and/or rinse cycle. The first perfume can be part of a detergent product to be delivered into the main wash cycle. Alternatively, the first perfume can be part of a rinse aid to be delivered into a rinse cycle.

The first perfume can also be delivered over a continuous period of time, i.e. during a plurality of dishwashing operations and in between them. The first perfume can be part of a machine freshener.

First Perfume

The first perfume is incomplete but still a perfume that is consumer acceptable. It will become complete after being exposed to sulphurous compounds. The first perfume is dominated by a fruity, citrus, floral and/or herbal character. The perfumer purposely would design the perfume incomplete leaving part or all of the sulphur notes out, thus the first perfume will become a full perfume when it encounters the sulphurous malodours in automatic dishwashing.

The perfumer would know how to create a consumer acceptable perfume by leaving out or reducing the sulphurous components.

Perfumery characters that typically comprise sulphur notes include: i) fruity perfumes such as mango, berry (including cassis, strawberry, blueberry, blackberry, raspberry, redcurrant, blackcurrant, cranberry and cherry), lychee, guava, grape, peach, peach skin, nectarine, apricot and passion fruit; ii) citrus perfumes such as bergamot, neroli and grapefruit; iii) floral perfumes such as lavender and geranium; and iv) green perfumes such as mint, mint leaf, tomato, tomato leaf, tomato vine, sage and clary sage and v) mixtures thereof.

The first perfume would typically comprises at least about 10%, more preferably at least about 20% and especially at least 30% by weight of the perfume of blooming perfume ingredients having a boiling point of less than 260° C. and a ClogP of at least 3. The first perfume would also typically comprise non-blooming perfume ingredients having a boiling point of more than 260° C. and a ClogP of at least 3, preferably less than about 30%, more preferably less than about 25% and preferably between 5 and 20% by weight of the perfume of non-blooming perfume ingredients.

The perfume compositions of the method of the present invention are very effusive and consumer noticeable, leaving minimal residual perfume on the washed items, including dishes, glasses and cutlery, especially those made of plastic, rubber and silicone. The compositions can leave a residual perfume in the automatic dishwashing machine that can be enjoyed by the user in between dishwashing operations.

A blooming perfume ingredient is characterized by its boiling point (B.P.) and its octanol/water partition coefficient (P). The octanol/water partition coefficient of a perfume ingredient is the ratio between its equilibrium concentrations in octanol and in water. Since the partition coefficients of the preferred perfume ingredients herein have high values, they are more conveniently given in the form of their logarithm to the base 10, logP. The B.P. herein is determined at the normal, standard pressure of 760 mm Hg.

Second Perfume

The second perfume would be formed once the first perfume is exposed to sulphurous compounds founds in automatic dishwashing.

Automatic Dishwashing Composition

The automatic dishwashing composition of the invention can comprise in addition to the first perfume a phosphate builder or a non-phosphate builder and one or more detergent active components which may be selected from surfactants, enzymes, bleach, bleach activator, bleach catalyst, polymers, dying aids and metal care agents.

Surfactant

Surfactants suitable for use herein include non-ionic surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the product of the invention comprises is a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]x[CH2CH2O]y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH)R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Amine oxides surfactants also useful in the present invention include linear and branched compounds having the formula:

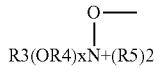

wherein R3 is selected from an alkyl, hydroxyalkyl, acylamidopropoyl and alkyl phenyl group, or mixtures thereof, containing from 8 to 26 carbon atoms, preferably 8 to 18 carbon atoms; R4 is an alkylene or hydroxyalkylene group containing from 2 to 3 carbon atoms, preferably 2 carbon atoms, or mixtures thereof; x is from 0 to 5, preferably from 0 to 3; and each R5 is an alkyl or hydroxyalkyl group containing from 1 to 3, preferably from 1 to 2 carbon atoms, or a polyethylene oxide group containing from 1 to 3, preferable 1, ethylene oxide groups. The R5 groups can be attached to each other, e.g., through an oxygen or nitrogen atom, to form a ring structure.

These amine oxide surfactants in particular include C10-C18 alkyl dimethyl amine oxides and C8-C18 alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are C10-C18 alkyl dimethylamine oxide, and C10-18 acylamido alkyl dimethylamine oxide.

Surfactants may be present in amounts from 0 to 10% by weight, preferably from 0.1% to 10%, and most preferably from 0.25% to 6% by weight of the composition.

Builder

Builders for use herein include phosphate builders and non-phosphate builders. If present, builders are used in a level of from 5 to 60% and preferably from 10 to 50% by weight of the composition. In some embodiments the composition may comprise a mixture of phosphate and non-phosphate builders.

Phosphate Builders

Preferred phosphate builders include mono-phosphates, di-phosphates, tri-polyphosphates or oligomeric-poylphosphates. The alkali metal salts of these compounds are preferred, in particular the sodium salts. An especially preferred builder is sodium tripolyphosphate (STPP).

Non-Phosphate Builders

Preferred non-phosphate builders include amino acid based compounds, in particular MGDA (methyl-glycine-diacetic acid), and salts and derivatives thereof, GLDA (glutamic-N,N-diacetic acid) and salts and derivatives thereof, IDS (iminodisuccinic acid) and salts and derivatives thereof, carboxy methyl inulin and salts and derivatives thereof and mixtures thereof. GLDA (salts and derivatives thereof) is especially preferred herein, with the tetrasodium salt thereof being especially preferred. Preferably MGDA or GLDA are present in the composition of the invention in a level of from 0.5% to 20%, more preferably from about 1% to about 10% and especially from about 2 to about 7% by weight of the composition.

Suitable builders for use herein, in addition or instead of MGDA and/or GLDA, include builders which forms water-soluble hardness ion complexes (sequestering builder) such as citrates and builders which forms hardness precipitates (precipitating builder) such as carbonates e.g. sodium carbonate.

Other suitable non-phosphate builders include amino acid based compound or a succinate based compound. The term "succinate based compound" and "succinic acid based compound" are used interchangeably herein. Other suitable builders are described in U.S. Pat. No. 6,426,229. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), alpha-alanine-N,N-diacetic acid (alpha-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Preferably the non-phosphate builder is present in the composition in an amount of at least 1%, more preferably at least 5%, even more preferably at least 10%, and most especially at least 20% by weight of the composition. Preferably these builders are present in an amount of up to 50%, more preferably up to 45%, even more preferably up to 40%, and especially up to 35% by weight of the composition. In preferred embodiments the composition contains 20% by weight of the composition or less of phosphate builders, more preferably 10% by weight of the composition or less, most preferably they are substantially free of phosphate builders.

Other non-phosphate builders include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

Polymer

The polymer, if present, is used in any suitable amount from about 0.1% to about 50%, preferably from 0.5% to about 20%, more preferably from 1% to 10% by weight of the composition. Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

(I)

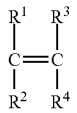

wherein $R^1$ to $R^4$ are independently hydrogen, methyl, carboxylic acid group or $CH_2COOH$ and wherein the carboxylic acid groups can be neutralized; (b) optionally, one or more structural units derived from at least one nonionic monomer having the general formula (II):

(II)

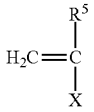

wherein $R^5$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

(III)

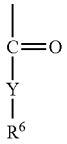

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

(IV)

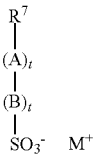

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth)acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Other suitable organic polymer for use herein includes a polymer comprising an acrylic acid backbone and alkoxylated side chains, said polymer having a molecular weight of from about 2,000 to about 20,000, and said polymer having from about 20 wt % to about 50 wt % of an alkylene oxide. The polymer should have a molecular weight of from about 2,000 to about 20,000, or from about 3,000 to about 15,000, or from about 5,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The polymers, preferably water soluble, may be configured as random, block, graft, or other known configurations. Methods for forming alkoxylated acrylic acid polymers are disclosed in U.S. Pat. No. 3,880,765.

Other suitable organic polymer for use herein includes polyaspartic acid (PAS) derivatives as described in WO 2009/095645 A1.

Enzyme

Enzyme Related Terminology

Nomenclature for Amino Acid Modifications

In describing enzyme variants herein, the following nomenclature is used for ease of reference: Original amino acid(s):position(s):substituted amino acid(s).

According to this nomenclature, for instance the substitution of glutamic acid for glycine in position 195 is shown as G195E. A deletion of glycine in the same position is shown as G195*, and insertion of an additional amino acid residue such as lysine is shown as G195GK. Where a specific enzyme contains a "deletion" in comparison with other enzyme and an insertion is made in such a position this is indicated as *36D for insertion of an aspartic acid in position 36. Multiple mutations are separated by pluses, i.e.: S99G+V102N, representing mutations in positions 99 and 102 substituting serine and valine for glycine and asparagine, respectively. Where the amino acid in a position (e.g. 102) may be substituted by another amino acid selected from a group of amino acids, e.g. the group consisting of N and I, this will be indicated by V102N/I.

In all cases, the accepted IUPAC single letter or triple letter amino acid abbreviation is employed.

Protease Amino Acid Numbering

The numbering used herein is numbering versus the so-called BPN' numbering scheme which is commonly used in the art and is illustrated for example in WO00/37627.

Amino Acid Identity

The relatedness between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

The degree of identity between an amino acid sequence of and enzyme used herein ("invention sequence") and a different amino acid sequence ("foreign sequence") is calculated as the number of exact matches in an alignment of the two sequences, divided by the length of the "invention sequence" or the length of the "foreign sequence", whichever is the shortest. The result is expressed in percent identity. An exact match occurs when the "invention sequence" and the "foreign sequence" have identical amino acid residues in the same positions of the overlap. The length of a sequence is the number of amino acid residues in the sequence.

Preferred enzyme for use herein includes a protease. Suitable proteases include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, including those derived from *Bacillus amyloliquefaciens* described in WO 07/044,993A2.

Preferred proteases include those derived from *Bacillus gibsonii* or *Bacillus Lentus.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference:

68, 87, 99, 101, 103, 104, 118, 128, 129, 130, 167, 170, 194, 205 & 222 and optionally one or more insertions in the region comprising amino acids 95-103.

Preferably, the mutations are selected from one or more, preferably two or more and more preferably three or more of the following: V68A, N87S, S99D, S99SD, S99A, S101G, S103A, V104N/I, Y167A, R1705, A194P, V205I and/or M222S.

Most preferably the protease is selected from the group comprising the below mutations (BPN' numbering system) versus either the PB92 wild-type (SEQ ID NO:2 in WO 08/010,925) or the subtilisin 309 wild-type (sequence as per PB92 backbone, except comprising a natural variation of N87S).

(i) G118V+S128L+P129Q+S130A
(ii) G118V+S128N+P129S+S130A+S166D
(iii) G118V+S128L+P129Q+S130A+S166D
(iv) G118V+S128V+P129E+S130K
(v) G118V+S128V+P129M+S166D
(vi) G118V+S128F+P129L+S130T
(vii) G118V+S128L+P129N+S130V
(viii) G118V+S128F+P129Q
(ix) G118V+S128V+P129E+S130K+S166D
(x) G118V+S128R+P129S+S130P
(xi) S128R+P129Q+S130D
(xii) S128C+P129R+S130D
(xiii) S128C+P129R+S130G
(xiv) S101G+V104N
(xv) N76D+N87S+S103A+V104I
(xvi) V68A+N87S+S101G+V104N
(xvii) S99SD+S99A
(xviii) N87S+S99SD+S99A Suitable commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao. Preferred for use herein in terms of performance is a dual protease system, in particular a system comprising a protease comprising S99SD+S99A mutations (BPN' numbering system) versus either the PB92 wild-type (SEQ ID NO:2 in WO 08/010,925) or the subtilisin 309 wild-type (sequence as per PB92 backbone, except comprising a natural variation of N87S). and a DSM14391 *Bacillus Gibsonii* enzyme, as described in WO 2009/021867 A2.

Preferred levels of protease in the product of the invention include from about 0.1 to about 10, more preferably from about 0.5 to about 5 and especially from about 1 to about 4 mg of active protease per grams of product.

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334).

Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:
26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp.707 (SEQ ID NO:7 in U.S. Pat. No. 6,093,562), especially those comprising one or more of the following mutations M202, M208, S255, R172, and/or M261. Preferably said amylase comprises one or more of M202L, M202V, M2025, M202T, M202I, M202Q, M202W, S255N and/or R172Q. Particularly preferred are those comprising the M202L or M202T mutations.

Preferred α-amylases include the below variants of SEQ ID No. 12 in WO 06/002643:

(a) one or more, preferably two or more, more preferably three or more substitutions in the following positions: 9, 26, 149, 182, 186, 202, 257, 295, 299, 323, 339 and 345; and
(b) optionally with one or more, preferably four or more of the substitutions and/or deletions in the following positions: 118, 183, 184, 195, 320 and 458, which if present preferably comprise R118K, D183*, G184*, N195F, R320K and/or R458K.

Preferred amylases include those comprising the following sets of mutations:

(i) M9L+, M323T;
(ii) M9L+M202L/T/V/I+M323T;
(iii) M9L+N195F+M202L/T/V/I+M323T;
(iv) M9L+R118K+D183*+G184*+R320K+M323T+R458K;
(v) M9L+R118K+D183*+G184*+M202L/T/V/I; R320K+M323T+R458K;
(vi) M9L+G149A+G182T+G186A+M202L+T257I+Y295F+N299Y+M323T+A339S+E345R;
(vii) M9L+G149A+G182T+G186A+M202I+T257I+Y295F+N299Y+M323T+A339S+E345R;
(viii) M9L+R118K+G149A+G182T+D183*+G184*+G186A+M202L+T257I+Y295F+N299Y+R320K+M323T+A339S+E345R+R458K;
(ix) M9L+R118K+G149A+G182T+D183*+G184*+G186A+M202I+T257I+Y295F+N299Y+R320K+M323T+A339S+E345R+R458K;

(x) M9L+R118K+D183*+D184*+N195F+M202L+R320K+M323T+R458K;

(xi) M9L+R118K+D183*+D184*+N195F+M202T+R320K+M323T+R458K;

(xii) M9L+R118K+D183*+D184*+N195F+M202I+R320K+M323T+R458K;

(xiii) M9L+R118K+D183*+D184*+N195F+M202V+R320K+M323T+R458K;

(xiv) M9L+R118K+N150H+D183*+D184*+N195F+M202L+V214T+R320K+M323T+R458K; or (xv) M9L+R118K+D183*+D184*+N195F+M202L+V214T+R320K+M323T+E345N+R458K.

(xvi) M9L+R118K+G149A+G182T+D183*+G184*+G186A+N195F+M202L+T257I+Y295F+N299Y+R320K+M323T+A339S+E345R+R458K Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN®, (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Additional Enzymes

Additional enzymes suitable for use in the product of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Cellulases

The product of the invention preferably comprises other enzymes in addition to the protease and/or amylase. Cellulase enzymes are preferred additional enzymes, particularly microbial-derived endoglucanases exhibiting endo-beta-1,4-glucanase activity (E.C. 3.2.1.4), including a bacterial polypeptide endogenous to a member of the genus *Bacillus* which has a sequence of at least 90%, preferably 94%, more preferably 97% and even more preferably 99% identity to the amino acid sequence SEQ ID NO:2 in U.S. Pat. No. 7,141,403B2 and mixtures thereof. Preferred commercially available cellulases for use herein are Celluzyme®, Celluclean®, Whitezyme® (Novozymes A/S) and Puradax HA® and Puradax® (Genencor International).

Preferably, the product of the invention comprises at least 0.01 mg of active amylase per gram of composition, preferably from about 0.05 to about 10, more preferably from about 0.1 to about 6, especially from about 0.2 to about 4 mg of amylase per gram of composition.

Preferably, the protease and/or amylase of the product of the invention are in the form of granulates, the granulates comprise less than 29% of efflorescent material by weight of the granulate or the efflorescent material and the active enzyme (protease and/or amylase) are in a weight ratio of less than 4:1.

Drying Aids

Preferred drying aids for use herein include polyesters, especially anionic polyesters formed from monomers of terephthalic acid, 5-sulphoisophthalic acid, alkyl diols or polyalkylene glycols, and, polyalkyleneglycol monoalkylethers. Suitable polyesters to use as drying aids are disclosed in WO 2008/110816. Other suitable drying aids include specific polycarbonate-, polyurethane- and/or polyurea-polyorganosiloxane compounds or precursor compounds thereof of the reactive cyclic carbonate and urea type, as described in WO 2008/119834.

Improved drying can also be achieved by a process involving the delivery of surfactant and an anionic polymer as proposed in WO 2009/033830 or by combining a specific non-ionic surfactant in combination with a sulfonated polymer as proposed in WO 2009/033972.

Preferably the composition of the invention comprises from 0.1% to 10%, more preferably from 0.5 to 5% and especially from 1% to 4% by weight of the composition of a drying aid.

Silicates

Preferred silicates are sodium silicates such as sodium disilicate, sodium metasilicate and crystalline phyllosilicates. Silicates if present are at a level of from about 1 to about 20%, preferably from about 5 to about 15% by weight of composition.

Bleach

Inorganic and organic bleaches are suitable cleaning actives for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate are preferred perhydrates for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and Nphthaloylaminoperoxicaproic acid are also suitable herein.

Further typical organic bleaches include the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.1 to about 10%, preferably from about 0.5 to about 2% by weight of the total composition.

Bleach Catalyst

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16. Bleach catalyst if included in the compositions of the invention are in a level of from about 0.1 to about 10%, preferably from about 0.5 to about 2% by weight of the total composition.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and specially from 0.3 to 3% by weight of the composition of a metal care agent, preferably the metal care agent is a zinc salt.

Auto-Dosing Delivery Device

The first perfume of the present invention can be placed into a delivery cartridge as that described in WO 2007/052004 and WO 2007/0833141. The dosing elements can have an elongated shape and set into an array forming a delivery cartridge which is the refill for an auto-dosing dispensing device as described in case WO 2007/051989. The delivery cartridge is to be placed in an auto-dosing delivery device, such as that described in WO 2008/053191.

All the percentages here in are by weight of the composition, unless stated otherwise.

EXAMPLE

Abbreviations Used in the Example

In the example, the abbreviated component identifications have the following meanings:

Carbonate: Anhydrous sodium carbonate

STPP: Sodium tripolyphosphate anhydrous

Silicate: Amorphous Sodium Silicate ($SiO_2$:$Na_2O$=from 2:1 to 4:1)

Alcosperse 240-D: Sulfonated polymer available from Alco Chemical 95% solids

Percarbonate: Sodium percarbonate of the nominal formula $2Na_2CO_3.3H_2O_2$

TAED: Tetraacetylethylenediamine

SLF18: Non-ionic surfactant available from BASF

Neodol 1-9: Non-ionic surfactant available from Shell

DPG: dipropylene glycol

In the following example all levels are quoted in percent by weight of the composition (either solid or liquid composition).

Examples

The compositions tabulated below are introduced into a multi-compartment pouch having a first compartment comprising the solid composition (in powder form) and a liquid compartment superposed onto the powder compartment comprising the liquid composition. The film used is Monosol M8630 film as supplied by Monosol. The weight of the solid composition is 17 grams and the weight of liquid compositions is 2.6 gram.

| | Formulation | | |
|---|---|---|---|
| Ingredient | 1 Level (% wt) | 2 Level (% wt) | 3 Level (% wt) |
| Solid composition | | | |
| STPP | 35 | 0 | 0 |
| Carbonate | 24 | 45 | 40 |
| Methylglycine diacetic acid (83% active) | 0 | 15 | 20 |
| Silicate | 7 | 7 | 7 |
| TAED | 0.5 | 0.5 | 0.5 |
| Zinc carbonate | 0.5 | 0.5 | 0.5 |
| SLF18 | 1.5 | 1.5 | 1.5 |
| Penta Amine Acetato-cobalt(III) nitrate (1% active) | 0.5 | 0.5 | 0.5 |
| Percarbonate | 15 | 15 | 15 |
| Sulphonated polymer[1] | 10 | 4 | 3 |
| Amylase (14.4 mg/g active)[2] | 1.3 | 1.8 | 1.5 |
| Protease[3] | 1 | 1 | 1 |
| Perfume[4] | 0.1 | | 0.1 |
| Perfume[5] | | 0.1 | |
| Processing aids and sodium sulphate | To balance | To balance | To balance |
| Liquid composition | | | |
| DPG | 45 | 45 | 45 |
| SLF18 | 45 | 45 | 45 |
| Neodol 1-9 | 3 | 3 | 3 |
| Glycerine | 2 | 2 | 2 |
| Processing aids | To balance | To balance | To balance |

[1]Suitable sulphonated polymers can be purchased from Akzo Nobel, e.g. Acusol 240-D,

[2]Suitable amylases can be purchased from Novozymes, e.g. amylase sold under tradename Stainzyme Plus ®.

[3]Suitable protease can be purchased from Genencor International, e.g. protease sold under tradename Excellase ®

[4]Perfume A as specified in the table below.

[4]Perfume B as specified in the table below.

| | Perfume | | |
|---|---|---|---|
| Material Name | A Level wt % | B Level wt % | Character |
| Anisic Aldehyde | 0.120 | 0.120 | |
| Citral | 0.300 | 0.300 | |
| Cymal | 0.300 | 0.300 | |
| Damascone Beta | 2.000 | 2.000 | berry |
| Decyl Aldehyde | 3.500 | 3.500 | |
| Delta Damascone | 0.400 | 0.400 | berry |
| Dihydro Myrcenol | 10.000 | 10.000 | bergamot |

-continued

| Material Name | Perfume A Level wt % | Perfume B Level wt % | Character |
|---|---|---|---|
| Dipentene | 1.300 | 1.300 | |
| Ethyl 2 Methyl Pentanoate | 0.400 | 0.400 | |
| Ethyl Butyrate | 0.600 | 0.600 | berry |
| Ethyl Maltol | 2.600 | 2.600 | berry |
| Ethyl-2-methyl Butyrate | 2.000 | 2.000 | |
| Eucalyptol | 0.800 | 0.800 | |
| Floral Super | 0.300 | 0.300 | |
| Gamma Decalactone | 4.500 | 4.500 | |
| Geraniol | 5.500 | 5.500 | geranium |
| Hexyl Salicylate | 3.000 | 3.000 | |
| Intreleven Aldehyde | 0.060 | 0.060 | |
| Ionone Alpha | 6.200 | 6.200 | |
| Lemonile | 2.800 | 2.800 | |
| Ligustral Or Triplal | 0.520 | 0.520 | |
| Lime Oxide | 0.800 | 0.800 | |
| Menthone Racemic | 0.100 | 0.100 | minty |
| Methyl Benzoate | 0.025 | 0.025 | |
| Methyl Cinnamate | 3.500 | 3.500 | |
| Methyl Dihydro Jasmonate | 4.800 | 4.800 | |
| Methyl Dioxolan | 0.600 | 0.600 | berry |
| Methyl Phenyl Carbinyl Acetate | 0.700 | 0.700 | |
| Octyl Aldehyde | 2.600 | 2.600 | |
| Para Hydroxy Phenyl Butanone | 0.200 | 0.200 | berry |
| Rhubafuran | 0.280 | 0.280 | |
| Scentenal | 0.120 | 0.120 | |
| Terpinyl Acetate | 7.000 | 7.000 | |
| Tetra Hydro Linalool | 6.700 | 6.700 | |
| Tridecene-2-nitrile | 0.300 | 0.300 | |
| Verdol | 0.120 | 0.120 | |
| Verdox | 12.400 | 12.400 | |
| Orange Oil Cold Pressed | 12.555 | 12.555 | |
| Total | 100.000 | 100.000 | |

Each of the exemplified pouches is used in an automatic dishwashing machine to wash a load soiled with 6 g of onion and garlic puree, the onion and garlic are in a weight ratio of 4:1. The pouches have a very pleasant fruity (berry), citrus, green smell. When the dishwasher is open to be unloaded a pleasant berry (cassis, blueberry) with citrus and green aspects is perceived. The smell can even be appreciated after 48 h.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A method of perfuming during an automatic dishwashing operation comprising the steps of: providing an automatic dishwashing detergent composition comprising a first perfume into an automatic dishwashing machine; performing an automatic dishwashing operation wherein said first perfume combines with a sulphurous malodor during said automatic dishwashing operation to generate a second perfume during said automatic dishwashing operation, said second perfume comprising from about 0.0001% to about 10% by weight thereof of a first sulphurous compound.

2. A method according to claim 1 wherein the first perfume is dominated by a note selected from i) fruity perfumes; ii) citrus perfumes; iv) green perfumes; and v) mixtures thereof.

3. A method according to claim 1 wherein the first perfume comprises from about 0.0001% to about 5% by weight thereof of a second sulphurous compound.

4. A method according to claim 1 wherein the sulphurous compound is an organosulphur compound.

5. A method according to claim 1 wherein the first perfume is delivered in a main wash cycle of the automatic dishwashing machine.

6. A method according to claim 1, wherein the automatic dishwashing detergent composition further comprises a non-phosphate builder, and wherein the non-phosphate builder is selected from the group consisting of methyl-glycine-diacetic acid, glutamic-N, N-diacetic acid, and mixtures thereof.

7. A method according to claim 2, wherein the fruity perfume is selected from the group consisting of mango, berry, cassis, strawberry, blueberry, blackberry, raspberry, redcurrant, blackcurrant, cranberry, cherry, lychee, guava, grape, peach, peach skin, nectarine, apricot, passion fruit, and mixtures thereof.

8. A method according to claim 2, wherein the citrus perfume is selected from the group consisting of bergamot, neroli, grapefruit, and mixtures thereof.

9. A method according to claim 2, wherein the floral perfume is selected from the group consisting of lavender, geranium, and mixtures thereof.

10. A method according to claim 2, wherein the green perfume is selected from the group consisting of mint, tomato, tomato leaf, sage, and mixtures thereof.

11. A method according to claim 6, wherein the automatic dishwashing detergent composition further comprises sulfonated/carboxylated polymers.

* * * * *

UNITED STATES PATENT AND TRADEMARK OFFICE

CERTIFICATE OF CORRECTION

PATENT NO. : 8,328,952 B2
APPLICATION NO. : 13/088441
DATED : December 11, 2012
INVENTOR(S) : Jukes et al.

It is certified that error appears in the above-identified patent and that said Letters Patent is hereby corrected as shown below:

Column 18

Line 27, insert -- iii) floral perfumes -- after ii) citrus perfumes;

Signed and Sealed this
Twelfth Day of February, 2013

Teresa Stanek Rea
*Acting Director of the United States Patent and Trademark Office*